US007087843B2

(12) United States Patent
Ishii et al.

(10) Patent No.: US 7,087,843 B2
(45) Date of Patent: Aug. 8, 2006

(54) MULTILAYER INSULATED WIRE AND TRANSFORMER USING THE SAME

(75) Inventors: Tadashi Ishii, Tokyo (JP); Yong Hoon Kim, Tokyo (JP); Atsushi Higashiura, Tokyo (JP); Isamu Kobayashi, Tokyo (JP)

(73) Assignee: The Furukawa Electric Co. Ltd., Tokyo (JP)

( * ) Notice: Subject to any disclaimer, the term of this patent is extended or adjusted under 35 U.S.C. 154(b) by 0 days.

(21) Appl. No.: 10/720,282

(22) Filed: Nov. 25, 2003

(65) Prior Publication Data

US 2004/0105991 A1 Jun. 3, 2004

Related U.S. Application Data

(63) Continuation of application No. PCT/JP02/05379, filed on May 31, 2002.

(30) Foreign Application Priority Data

Jun. 1, 2001 (JP) ..... 2001-167363
Jun. 1, 2001 (JP) ..... 2001-167366

(51) Int. Cl.
*H01B 3/30* (2006.01)

(52) U.S. Cl. ..... 174/110 R; 174/120 R

(58) Field of Classification Search ..... 174/36, 174/110 R, 113 R, 120 R, 120 SR, 126.1, 174/126.2

See application file for complete search history.

(56) References Cited

U.S. PATENT DOCUMENTS 4,320,224 A * 3/1982 Rose et al. ..... 528/125
4,908,418 A * 3/1990 Holub ..... 525/425
5,001,304 A * 3/1991 Hardin et al. ..... 174/107
5,041,335 A * 8/1991 Inai et al. ..... 428/416
5,166,238 A * 11/1992 Nakano et al. ..... 524/120
5,358,786 A 10/1994 Ishikawa et al.
5,426,264 A * 6/1995 Livingston et al. ..... 174/102 R
5,492,761 A * 2/1996 Shukushima ..... 428/379
5,606,152 A 2/1997 Higashiura et al.
5,710,475 A * 1/1998 Irwin et al. ..... 310/254
6,066,806 A * 5/2000 Higashiura et al. ..... 174/110 R
6,359,230 B1 * 3/2002 Hildreth ..... 174/110 R

FOREIGN PATENT DOCUMENTS

DE 41 21 547 A1 1/1993
DE 42 00 311 A1 7/1993
EP 0 421 193 A1 4/1991
EP 0 425 294 A2 5/1991
EP 0 440 118 A2 8/1991

(Continued)

*Primary Examiner*—William H. Mayo, III
(74) *Attorney, Agent, or Firm*—Birch, Stewart, Kolasch & Birch, LLP

(57) ABSTRACT

A multilayer insulated wire having two or more extrusion-insulating layers provided on a conductor to coat the conductor, wherein at least one layer of the insulating layers is composed of a polyethersulfone resin (i), or a resin mixture (ii) made by blending: 100 parts by weight of a resin (A) of at least one selected from polyetherimide resins and polyethersulfone resins, and 10 parts by weight or more of a resin (B) of at least one selected from polycarbonate resins, polyarylate resins, polyester resins and polyamide resins; and wherein at least one layer other than the insulating layer composed of the resin (i) or resin mixture (ii) is provided as an outer layer to the insulating layer and is composed of a polyphenylenesulfide resin. A transformer can also have the mentioned multi-layered insulated wire.

12 Claims, 1 Drawing Sheet

FOREIGN PATENT DOCUMENTS

| | | | | |
|---|---|---|---|---|
| EP | 0944099 | A | | 9/1999 |
| EP | 0949634 | A | | 10/1999 |
| JP | 63-29412 | A | | 2/1988 |
| JP | 4-245110 | A | | 1/1992 |
| JP | 04-245110 | | * | 9/1992 |
| JP | 04-345703 | | * | 12/1992 |
| JP | 4-345703 | A | | 12/1992 |
| JP | 5-12924 | A | | 1/1993 |
| JP | 5-152139 | A | | 6/1993 |
| JP | 10-125140 | | * | 5/1998 |
| JP | 10-125140 | A | | 5/1998 |
| JP | 10-134642 | A | | 5/1998 |

* cited by examiner

MULTILAYER INSULATED WIRE AND TRANSFORMER USING THE SAME

This application is a Continuation of copending PCT International Application No. PCT/JP02/05379 filed on May 31, 2002, which designated the United States, and on which priority is claimed under 35 U.S.C. § 120, the entire contents of which are hereby incorporated by reference and this Nonprovisional application claims priority under 35 U.S.C. § 119(a) on Patent Application No(s). 2001-167363 and 2001-167366 filed in JAPAN on Jun. 1, 2001, the entire contents of which are hereby incorporated by reference.

TECHNICAL FIELD

The present invention relates to a multilayer insulated wire whose insulating layers are composed of two or more extrusion-coating layers. The present invention also relates to a transformer in which the multilayer insulated wire is utilized.

BACKGROUND ART

The structure of a transformer is prescribed by IEC (International Electrotechnical Communication) Standards Pub. 60950, and the like. That is, these standards provide that at least three insulating layers be formed between primary and secondary windings in a winding, in which an enamel film which covers a conductor of a winding be not authorized as an insulating layer (an insulation thin-film material), or that the thickness of an insulating layer be 0.4 mm or more. The standards also provide that the creepage distance between the primary and secondary windings, which varies depending on the applied voltage, be 5 mm or more, that the transformer withstand a voltage of 3,000 V applied between the primary and secondary sides for a minute or more, and the like.

According to such standards, as a currently prevailing transformer has a structure such as one illustrated in a cross-sectional view of FIG. 2. In the structure, an enameled primary winding 4 is wound around a bobbin 2 on a ferrite core 1 in a manner such that insulating barriers 3 for securing the creepage distance are arranged individually on the opposite sides of the peripheral surface of the bobbin. An insulating tape 5 is wound for at least three turns on the primary winding 4, additional insulating barriers 3 for securing the creepage distance are arranged on the insulating tape, and an enameled secondary winding 6 is then wound around the insulating tape.

Recently, a transformer having a structure which includes neither the insulating barriers 3 nor the insulating tape layer 5, as shown in FIG. 1, has started to be used in place of the transformer having the structure shown in the cross-section of FIG. 2. The transformer shown in FIG. 1 has an advantage over the one having the structure shown in FIG. 2, in being able to be reduced in overall size and dispense with the winding operation for the insulating tape.

In manufacturing the transformer shown in FIG. 1, it is necessary, in consideration of the aforesaid IEC standards, that at least three insulating layers 4*b* (6*b*), 4*c* (6*c*), and 4*d* (6*d*) are formed on the outer peripheral surface on one or both of conductors 4*a* (6*a*) of the primary winding 4 and the secondary winding 6 used.

As such a winding, a winding in which an insulating tape is first wound around a conductor to form a first insulating layer thereon, and is further wound to form second and third insulating layers in succession, so as to form three insulating layers that are separable from one another, is known. Further, a winding in which a conductor is successively extrusion-coated with a fluororesin, in place of an insulating tape, whereby extrusion-coating layers composed of three-layer structure in all are formed for use as insulating layers, is known.

In the above-mentioned case of winding an insulating tape, however, because winding the tape is an unavoidable operation, the efficiency of production is extremely low, and thus the cost of the electrical wire is conspicuously increased.

In the above-mentioned case of extrusion of a fluororesin, since the insulating layer is made of the fluororesin, there is the advantage of good heat resistance. On the other hand, because of the high cost of the resin and the property that when it is pulled at a high shearing speed, the state of the external appearance is deteriorated, it is difficult to increase the production speed, and like the insulating tape, the cost of the electric wire becomes high.

To solve such a problem, a multilayer insulated wire is put to practical use, in which the outer periphery of a conductor is coated, by extrusion, with a modified polyester resin of which the crystallization is controlled, and which is restricted in a reduction in molecular weight, as the first and second insulating layers, and with a polyamide resin as the third insulating layer. Moreover, as a multilayer insulated wire that is more improved in heat resistance, those produced by extrusion-coating with a polyethersulfone resin as the inner layer, and with a polyamide resin as the outermost layer, are proposed.

However, along with recent development of small-sized and high-density electric and electronic machineries and tools, there has been concern about the influence of the heat generated from constituted parts, and the influence of impaired radiating ability. Therefore, higher heat resistance, high chemical resistance, such as resistance to a solvent, from the viewpoint of handling, and also improvements in life time and corona resistance also as to electrical properties, are required. However, insulated wires fulfilling all of these requirements have not been realized at present.

DISCLOSURE OF INVENTION

The present invention is a multilayer insulated wire having two or more extrusion-insulating layers provided on a conductor to coat the conductor, wherein at least one layer of the insulating layers is composed of a polyethersulfone resin, and wherein at least one layer other than the at least one insulating layer is provided as an outer layer to the at least one insulating layer and is composed of a polyphenylenesulfide resin.

Further, the present invention is a multilayer insulated wire having two or more solderable extrusion-insulating layers provided on a conductor to coat the conductor, wherein at least one layer of the insulating layers is composed of a resin mixture made by blending: 100 parts by weight of a resin (A) of at least one selected from the group consisting of a polyetherimide resin and a polyethersulfone resin, and 10 parts by weight or more of a resin (B) of at least one selected from the group consisting of a polycarbonate resin, a polyarylate resin, a polyester resin and a polyamide resin, and wherein at least one layer other than the at least one insulating layer composed of the resin mixture is provided as an outer layer to the at least one insulating layer and is composed of a polyphenylenesulfide resin.

Further, the present invention is a transformer, in which any one of the above multilayer insulated wire is used.

Other and further features and advantages of the invention will appear more fully from the following description, taken in connection with the accompanying drawings.

BEST MODE FOR CARRYING OUT THE INVENTION

Figure 1:
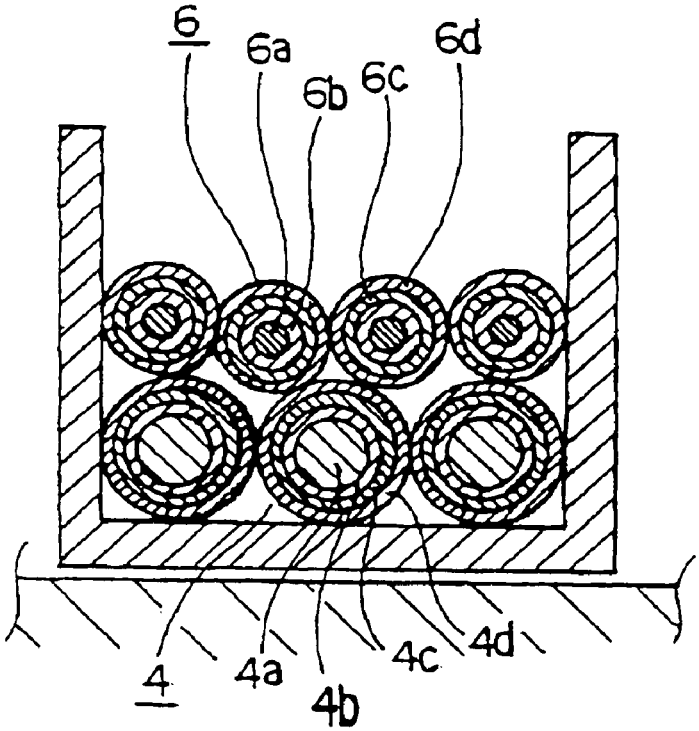
FIG. 1 is a cross-sectional view illustrating an example of the transformer having a structure in which three-layer insulated wires are used as windings.

According to the present invention, there is provided the following means:

(1) A multilayer insulated wire having two or more extrusion-insulating layers provided on a conductor to coat the conductor, wherein at least one layer of the insulating layers is composed of a polyethersulfone resin, and wherein at least one layer other than the at least one insulating layer is provided as an outer layer to the at least one insulating layer and is composed of a polyphenylenesulfide resin.

(2) A multilayer insulated wire having two or more solderable extrusion-insulating layers provided on a conductor to coat the conductor, wherein at least one layer of the insulating layers is composed of a resin mixture made by blending: 100 parts by weight of a resin (A) of at least one selected from the group consisting of a polyetherimide resin and a polyethersulfone resin, and 10 parts by weight or more of a resin (B) of at least one selected from the group consisting of a polycarbonate resin, a polyarylate resin, a polyester resin and a polyamide resin, and wherein at least one layer other than the at least one insulating layer composed of the resin mixture is provided as an outer layer to the at least one insulating layer and is composed of a polyphenylenesulfide resin.

(3) The multilayer insulated wire as stated in the above item (2), wherein the resin (A) is a polyethersulfone resin.

(4) The multilayer insulated wire as stated in the above item (2), wherein the resin (B) is a polycarbonate resin.

(5) The multilayer insulated wire as stated in the above item (2), wherein the resin (A) is a polyethersulfone resin and the resin (B) is a polycarbonate resin.

(6) The multilayer insulated wire as stated in any one of the above items (2) to (5), wherein the resin mixture is made by blending: 100 parts by weight of the resin (A), and 10 to 70 parts by weight of the resin (B).

(7) The multilayer insulated wire according to any one of the above items (1) to (6), wherein the polyphenylenesulfide resin to form the at least one insulating layer initially has a loss modulus that is two or more times a storage modulus, at 300° C. and 1 rad/s in a nitrogen atmosphere.

(8) The multilayer insulated wire according to any one of the above items (1) to (7), wherein the outermost layer among the insulating layers is composed of a polyphenylenesulfide resin.

(9) The multilayer insulated wire according to any one of the above items (1) to (8), wherein the at least one insulating layer is composed of a mixture made by blending: 10 to 85 parts by weight of an inorganic filler, and 100 parts by weight of the polyethersulfone resin or the resin mixture of the resins (A) and (B).

(10) A transformer, comprising the multilayer insulated wire according to any one of the above items (1) to (9).

The present invention will be described in detail below.

In the multilayer insulated wire of the present invention, the insulating layers are composed of two or more layers, preferably three layers.

In an insulating layer, an arbitrarily polyethersulfone resin, as a resin having high heat resistance, may be selected and used from known resins, and those represented by the following formula (1) can be preferably used:

formula (1)

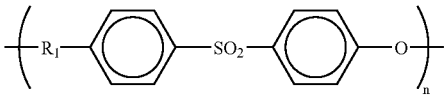

wherein $R_1$ represents a single bond or —$R_2$—O—, in which $R_2$, which may be substituted, represents a phenylene group, a biphenylylene group, or

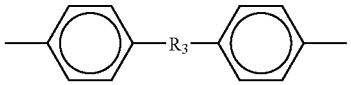

in which $R_3$ represents an alkylene group, such as —C—$(CH_3)_2$— and —$CH_2$—, and n is a positive integer large enough to give the polymer.

The method of producing these resins is known per se, and as an example, a manufacturing method in which a dichlorodiphenyl sulfone, bisphenol S, and potassium carbonate are reacted in a high-boiling solvent, can be mentioned. As commercially available resins, for example, SUMIKAEXCEL PES (trade name, manufactured by Sumitomo Chemical Co., Ltd.) and Radel A (trade name, manufactured by BP•Amoco) can be mentioned.

Other heat-resistant thermoplastic resins and usually used additives, inorganic fillers, processing auxiliaries, colorants and the like may be added to the insulating layer, to the extent that the heat resistance is not impaired.

As the structure of the insulating layer of the multilayer insulated wire, a insulating layer with two or more layers obtained by extrusion-coating with the polyethersulfone resin is preferable, because heat resistance is ensured. Also, when the conductor is extrusion-coated with the polyethersulfone resin, the conductor may be preheated, if necessary. When the conductor is preheated, the temperature is preferably set to 140° C. or less. The adhesion between the conductor and the polyethersulfone resin is more strengthened by carrying out the preheating.

On the other hand, when solderability is particularly required of an insulating layer, it is preferable that among the insulating layers, at least one insulating layer composed of the resin mixture of the resins (A) and (B) be formed. When heat resistance is regarded as important, all layers except for the outermost layer are preferably composed of this resin mixture.

As the resin (A), any one of the polyethersulfone resin having high heat-resistance may be arbitrarily selected and used from known resins. Further, as the resin (A), a polyetherimide resin can also be used. The polyetherimide resin, as well as the methods of producing the polyetherimide resin, are known. For example, the polyetherimide resin can be synthesized by solution polycondensation of 2,2'-bis[3-(3,4-dicarboxyphenoxy)-phenyl]propanediacid anhydride and 4,4'-diaminodiphenylmethane, in ortho-dichlorobenzene as a solvent.

The polyetherimide resin is preferably represented by formula (2):

formula (2)

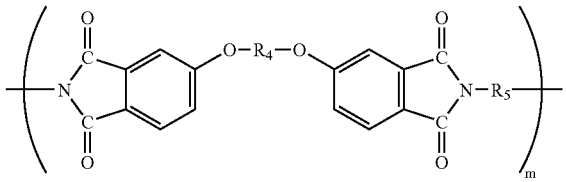

wherein $R_4$ and $R_5$, which may be substituted, each represent a phenylene group, a biphenylylene group,

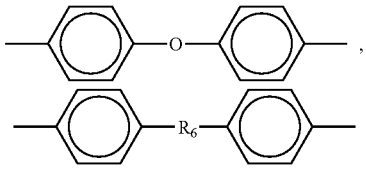

in which $R_6$ represents an alkylene group preferably having 1 to 7 carbon atoms (such as preferably methylene, ethylene, and propylene (particularly preferably isopropylidene)), or a naphthylene group, each of which $R_4$ and $R_5$ may have a substituent, such as an alkyl group (e.g. methyl and ethyl); and m is a positive integer large enough to give the polymer.

As commercially available resins, for example, ULTEM (trade name, manufactured by GE Plastics Ltd.) can be mentioned.

In the present invention, by mixing the heat-resistant resin (A) with the resin (B), the resulting resin composition is given solderability.

The above-mentioned polycarbonate resins, polyarylate resins, polyester resins, and polyamide resins, each of which can be used as the resin (B), are not particularly restricted. As the polycarbonate resins, use can be made of those produced by a known method using, for example, dihydric alcohols, phosgene, and the like, as raw materials. As commercially available resins, for example, Lexan (trade name, manufactured by GE Plastics Ltd.), Panlite (trade name, manufactured by Teijin Chemicals Ltd.), and Upiron (trade name, manufactured by Mitsubishi Gas Chemical Co., Inc.) can be mentioned. As the polycarbonate resins that can be used in the present invention, known polycarbonate resins can be used, such as those represented by formula (3):

formula (3)

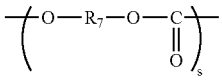

wherein $R_7$ represents a phenylene group, a biphenylylene group,

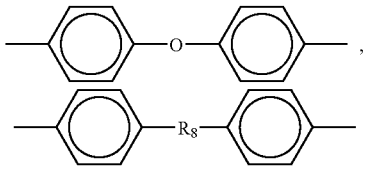

in which $R_8$ represents an alkylene group preferably having 1 to 7 carbon atoms (such as preferably methylene, ethylene, or propylene (particularly preferably isopropylidene)), or a naphthylene group, each of which may have a substituent, such as an alkyl group (e.g. methyl and ethyl); and s is a positive integer large enough to give the polymer.

Further, the polyarylate resins are generally produced by the interfacial polymerization method, in which, for example, bisphenol A dissolved in an aqueous alkali solution, and a terephthalic chloride/isophthalic chloride mixture dissolved in an organic solvent, such as a halogenated hydrocarbon, are reacted at normal temperature, to synthesize the resin. As commercially available resins, for example, U-polymer (trade name, manufactured by Unitika Ltd.) can be mentioned.

Further, as the polyester resins, those produced by a known method using, as raw materials, dihydric alcohols, divalent aromatic carboxylic acids, and the like, can be used. As commercially available resins, use can be made of polyethylene terephthalate (PET)-series resins, such as Byropet (trade name, manufactured by Toyobo Co., Ltd.); polyethylene naphthalate (PEN)-series resins, such as Teijin PEN (trade name, manufactured by Teijin Ltd.).

Further, as the polyamide resins, those produced by a known method using, as raw materials, diamines, dicarboxylic acids, and the like, can be used. As commercially available resins, for example, nylon 6,6, such as Amilan (trade name, manufactured by Toray Industries, Inc.), Zytel (trade name, manufactured by E. I. du Pont DeNemours & Co., Inc.), Maranyl (trade name, manufactured by Unitika Ltd.); and nylon 6,T, such as ARLEN (trade name, manufactured by Mitsui Chemical), can be mentioned.

In the present invention, the amount of the resin (B) to be mixed to 100 parts by weight of the resin (A) is 10 parts by weight or more. When the amount of the resin (B) is less than 10 parts by weight, to 100 parts by weight of the resin (A), heat resistance is increased but solderability cannot be obtained. The upper limit of the amount of the resin (B) to be mixed is determined taking the level of the required heat resistance into account, and it is preferably 100 parts by weight or less. When a particularly high level of heat resistance is to be realized while keeping high solderability, the amount of the resin (B) to be used is preferably 70 parts by weight or less, and a preferable range wherein both of these properties are particularly well balanced is more preferably that the amount of the resin (B) to be mixed is 20 to 50 parts by weight, to 100 parts by weight of the resin (A).

The above resin composition can be prepared by melting and mixing by using a usual mixer, such as a twin-screw extruder and a co-kneader. It has been found that the mixing temperature of the resins to be mixed has an influence on the direct solderability, and the higher the mixing temperature of the mixer is set at, the better the resulting solderability is. Preferably the mixing temperature is set at 320° C. or higher, and particularly preferably 360° C. or higher.

Other heat-resistant thermoplastic resins and usually used additives, inorganic fillers, processing auxiliaries, colorants and the like may be added to the insulating layer, to the extent that the solderability and the heat resistance are not impaired.

As the structure of the insulating layer of the multilayer insulated wire, a insulating layer with a combination of two or more layers obtained by extrusion-coating with the resin mixture is preferable, because of a good balance between the securement of heat resistance and solderability. Further, when the resin mixture is applied to a conductor by extrusion-coating, it is preferable for the resultant solderability that the conductor is not preliminarily heated (preheated). When the conductor is preliminarily heated, preferably the temperature is set to 140° C. or below. This is because the weakening of the adhesion between the conductor and the resin mixture coating layer due to not heating the conductor, together with a large heat shrinkage of 10 to 30% of the resin mixture coating layer in the direction of the wire length at the time of soldering, improves the solderability.

At least one insulating layer composed of a polyphenylenesulfide resin is formed outside of the insulating layer composed of the polyethersulfone resin or the resin mixture.

As to the polyphenylenesulfide resin, there is a usual method for producing it by running a polymerization-condensation reaction between p-dichlorobenzene and NaSH/NaOH or sodium sulfide in N-methylpyrrolidone, at a high temperature under pressure. Examples of the type of polyphenylenesulfide resin include a cross-linked molecular construction polymer type (hereinafter, abbreviated to a cross-linked type) and a linear molecular construction polymer type (hereinafter, abbreviated to a linear type). In the case of the cross-linked type, a cyclic oligomer produced during the reaction is incorporated into a polymer in a heat crosslinking step. The linear type is a polyphenylenesulfide resin that is made to have a high molecular weight in the course of the reaction using a polymerization agent. The resin which can be preferably used in the present invention is a polyphenylenesulfide resin mainly containing a linear-chain type. In the present invention, it is preferable to use the polyphenylenesulfide resin that initially has the loss modulus being two or more times the storage modulus, at 1 rad/s and 300° C. in a nitrogen atmosphere. As to a method of evaluation, the evaluation is easily made by utilizing an apparatus for measuring the time dependency of the loss modulus and storage modulus. As examples of the apparatus, Ares Measuring Device, manufactured by Reometric Scientific, can be mentioned. The ratio between these two modulus is a standard of cross-linked level. It is sometimes difficult to accomplish molding processing in the case of a polyphenylenesulfide resin having a loss modulus less than twice the storage modulus.

The polyphenylenesulfide resin mainly containing a linear type can be processed by continuous extrusion-molding and has a flexibility sufficient as the coating layer of the multilayer insulated wire. On the other hand, in the case of the cross-linked type polyphenylenesulfide resin, there is a possibility of the formation of a gelled product during molding. It is however possible to combine the polyphenylenesulfide resin mainly containing a linear type with the cross-linked type polyphenylenesulfide resin, or to further contain, for example, a cross-linked component and a branched component in the polymer, to the extent that the molding processing is not inhibited. Herein, the phrase "mainly containing a linear type" means that the linear type polyphenylenesulfide resin component occupies generally 70 mole % or more, in the whole components of the polyphenylenesulfide resin.

Further, the polyphenylenesulfide resin, in the case of a thick film, generally has the characteristics that the elongation percentage when it is ruptured with tensile is very low, specifically, 1 to 3% in the case of a cross-linked type and 20 to 40% in the case of even a linear type. Therefore, the thick polyphenylenesulfide resin film is unsuitable to the use as the coating material of insulated wires at all. However, the inventors of the present invention have surprisingly found that in the case of a thin-film (180 μm or less) structure such as those used in the present invention, the elongation percentage at the time of tensile rupture can be increased up to 50 to 70%, when the polyphenylenesulfide resin mainly containing a linear type is used. If the elongation percentage at the time of tensile rupture is 50% or more, this shows that such a material has flexibility sufficient as the coating material.

Further, when at least one layer composed of this polyphenylenesulfide resin is provided outside of the aforementioned insulating layer composed of the polyethersulfone resin or the resin mixture, chemical resistance such as solvent resistance can be improved more significantly than in the case of providing no such a layer. Resins such as crystalline resins are known to have strong resistance to chemicals such as solvents. However, such a resin has been found for the first time, which has chemical resistance even in the case of such a thin film structure as that used in the present invention, which can be extrusion-molded at a high rate, and which can also possess characteristics as a multilayer insulated wire. As viewing from the point of heat resistance, it is assumed that the polyphenylenesulfide resin has sufficient heat resistance even in the case of a thin-film structure, because it is basically different in oxidation mechanism from other resins such as a polyamide resin having an oxidation mechanism in which oxidation is advanced to the inside by a deterioration caused by thermal oxidation from the surface.

Further, it has been confirmed that the multilayer insulated wire of the present invention has an effect on improvement in life time characteristics among electrical properties. Although it is said that anti-tracking property is not good in the case of the polyphenylenesulfide resin, it has been found that the life time in a charging test is prolonged and the polyphenylenesulfide resin has an effect on corona resistance, by utilizing the polyphenylenesulfide resin as a part of the insulating layer structure of the multilayer insulated wire in the present invention. This is based on reduction in generation of ozone caused by discharging, and beyond imagination from the viewpoint of conventional technologies of molding materials which technologies are cultivated through injection molding and the like. These effects are developed for the first time by using the claimed constitution of the present invention.

Examples of commercially available polyphenylenesulfide resins include Fortron (trade name, manufactured by Polyplastics), Dic. PPS (trade name, manufactured by Dainippon Ink & Chemicals, Inc.), and PPS (trade name, manufactured by DIC EP). Among these resins, for example, Fortron (0220 A9 (grade name)), DIC-PPS (FZ-2200-A5 (grade name)), and DIC EP•PPS (LT-4P (grade name)) have the following ratios of the modulus (i.e. loss modulus/storage modulus) (in a nitrogen atmosphere, 1 rad/s, 300° C.): 3.5, 3.5 and 5.9, respectively, and these are therefore preferable.

Other heat-resistant thermoplastic resins, thermoplastic elastomers, and usually used additives, inorganic fillers, processing auxiliaries, colorants, and the like may be added, to the extent that heat resistance and resistance to chemicals are not impaired. When performing mold-processing, a method in which nitrogen is substituted for air may be adopted, to suppress a branching and a crosslinking reaction caused by oxidation in a molding machine.

Annealing treatment may be carried out according the need, after molding processing. This annealing makes higher crystallinity possible, and further improves resistance to chemicals.

With regard to the inorganic filler, when it is blended in an amount of 10 to 85 parts by weight, to 100 parts by weight of the polyethersulfone resin or 100 parts by weight of the resin mixture of the aforementioned resins (A) and (B), the resultant insulated wire can be further improved in electrical properties and the above-defined range is therefore preferable.

As the inorganic filler, for example, titanium oxide, silica (silicon dioxide), and alumina can be used. As a commercially available product, use can be made of, as titanium oxide, FR-88 (grade name, manufactured by FURUKAWA CO., LTD., an average particle diameter: 0.19 μm); as silica, 5X (grade name, manufactured by Tatsumori, Ltd., an average particle diameter: 1.5 μm); and as alumina, RA-30 (grade name, manufactured by Iwatani International Corporation, an average particle diameter: 0.1 μm). When the amount of the inorganic filler to be added is too small, the effect of the filler on electrical properties is not exhibited, while when the amount is too large, the flexibility required for the multilayer insulated wire is not obtained, and heat resistance is impaired. The addition of the inorganic filler can significantly improve, particularly, the life time.

As the conductor for use in the present invention, a metal bare wire (solid wire), an insulated wire having an enamel film or a thin insulating layer coated on a metal bare wire, a multicore stranded wire (a bunch of wires) composed of twisted metal bare wires, or a multicore stranded wire composed of twisted insulated-wires that each have an enamel film or a thin insulating layer coated, can be used. The number of the twisted wires of the multicore stranded wire can be chosen arbitrarily depending on the desired high-frequency application. Alternatively, when the number of wires of a multicore wire is large, for example, in a 19- or 37-element wire, the multicore wire (elemental wire) may be in a form of a stranded wire or a non-stranded wire. In the non-stranded wire, for example, multiple conductors that each may be a bare wire or an insulated wire to form the element wire, may be merely gathered (collected) together to bundle up them in an approximately parallel direction, or the bundle of them may be twisted in a very large pitch. In each case of these, the cross-section thereof is preferably a circle or an approximate circle. However, it is required that, as the material of the thin insulating layer, a resin that is itself good in solderability, such as an esterimide-modified polyurethane resin, a urea-modified polyurethane resin, and a polyesterimide resin, be used, and specifically, for example, WD-4305 (trade name, manufactured by Hitachi Chemical Co., Ltd.), TSF-200 and TPU-7000 (trade names, manufactured by Totoku Toryo Co.), and FS-304 (trade name, manufactured by Dainichi Seika Co.) can be used. Further, application of solder to the conductor or plating of the conductor with tin is a means of improving the solderability.

To state the structure of a preferable embodiment of the present invention, this multilayer insulated wire can be produced by extrusion-coating the outer periphery of a conductor with a polyethersulfone resin to form a insulating layer having a desired thickness as a first layer, and by extrusion-coating the outer periphery of the first insulating layer with a polyethersulfone resin to form an insulating layer having a desired thickness as a second layer, and further by extrusion-coating the outer periphery of the second insulating layer with a polyphenylenesulfide resin to form an insulating layer having a desired thickness as a third layer. Preferably, in the case of three layers, the overall thickness of the extrusion-coating insulating layers thus formed is controlled within the range of 60 to 180 μm. This is because the electrical properties of the resulting heat-resistant multilayer insulated wire may be greatly lowered to make the wire impractical, if the overall thickness of the insulating layers is too thin. On the other hand, the solderability may be deteriorated considerably, if the overall thickness of the insulating layers is too thick. More preferably, the overall thickness of the extrusion-insulating layers is in the range of 70 to 150 μm. Preferably, the thickness of each of the above three layers is controlled within the range of 20 to 60 μm.

Meanwhile, when the solderability is regarded as important, the aforementioned resin mixture to be used in the present invention is applied by extrusion-coating, to form the first and second insulating layers, thereby exhibiting intended properties.

The multilayer insulated wire of the present invention has at least one layer composed of the polyethersulfone resin, as an insulating layer, and has at least one layer composed of the polyphenylenesulfide resin provided as an outer layer of the above insulating layer, and the multilayer insulated wire can fulfill necessary heat resistance, chemical resistance and higher electrical properties. Further, when the multilayer insulated wire is a type having at least one layer composed of the resin mixture as a insulating layer and having at least one layer composed of the polyphenylenesulfide resin provided outside of the above insulating layer, it can fulfill, also, the solderability, besides the above-mentioned characteristics.

The transformer of the present invention, in which the multilayer insulated wire of the present invention is used, not only satisfies the IEC 60950 standards, it is also applicable to design severe in the required quality level, since there is no winding of an insulating tape, such that the transformer can be made small in size and heat resistance is high.

Figure 2:
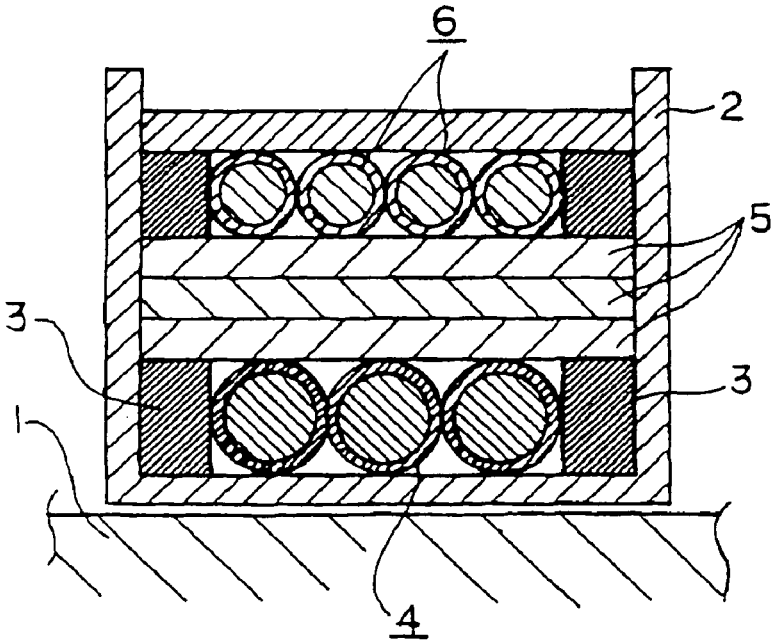
FIG. 2 is a cross-sectional view illustrating an example of the transformer having a conventional structure.

The multilayer insulated wire of the present invention can be used as a winding for any type of transformer, including those shown in FIGS. 1 and 2. In a transformer, generally a primary winding and a secondary winding are wound in a layered manner on a core, but the multilayer insulated wire of the present invention may be applied to a transformer in which a primary winding and a secondary winding are alternatively wound (JP-A-5-152139 ("JP-A" means unexamined published Japanese patent application)). In the transformer of the present invention, the above multilayer insulated wire may be used as both primary and secondary windings or as one of primary and secondary windings. Further, when the multilayer insulated wire of the present invention has two layers (for example, when both of a primary winding and a secondary winding are the two-layer insulated wires, or when one of a primary winding and a secondary winding is an enameled wire and the other is the two-layer insulated wire), at least one insulating barrier layer may be interposed between the windings for use.

According to the present invention, can be provided the multilayer insulated wire that is useful as a lead wire and a winding of a transformer, to be incorporated, for example, in electrical and electronic machinery and tools; and that is excellent in heat resistance and in chemical resistance. Further, in an embodiment of the insulation material to be used in the insulating layer, the present invention can provide the multilayer insulated wire having such excellent solderability that, when the wire is dipped in a solder bath, the insulating layer can be removed in a short period of time, to allow the solder to adhere easily to the conductor.

According to the present invention, can be provided the multilayer insulated wire that is excellent in heat resistance and chemical resistance, that is improved in life time characteristics as to the electric properties, that is excellent in corona resistance, and that is preferable for industrial production. Further, according to the present invention, can be provided a highly reliable transformer, which is obtained by winding such a multilayer insulated wire.

The multilayer insulated wire of the present invention not only satisfactorily fulfills a required level of heat resistance but also is excellent in solvent resistance and chemical resistance, and therefore enables a wide selection of processes in the post-treatment in succession to winding processing.

Further, according to the multilayer insulated wire of the present invention, a specified resin mixture is applied to at least one insulating layer, whereby soldering can be carried out directly in the processing of terminals.

The transformer of the present invention produced by using the aforementioned multilayer insulated wire is excellent in electrical properties and is highly reliable.

EXAMPLES

The present invention will now be described in more detail with reference to the following examples, but the invention is not limited to these.

Examples 1 to 26 and Comparative Examples 1 to 7

As conductors, were prepared, bare wires (solid wires) of annealed copper wires of diameter 0.4 mm, and stranded wires, each composed of seven twisted cores (insulated wires), each made by coating an annealed copper wire of diameter 0.15 mm with an insulating varnish WD-4305 (trade name), manufactured by Hitachi Chemical Co., Ltd., so that the coating thickness of the varnish layer would be 8 μm. The conductors were respectively coated successively, by extrusion-coating, with the resins having the formulations (compositions are shown in terms of parts by weight) for extrusion-coating and the thicknesses to form each of the layers, as shown in Tables 1 to 4, thereby preparing multilayer insulated wires (surface treatment: use was made of a refrigerating machine oil).

The aforementioned resin composition was made by mixing, utilizing a 30 mmΦ twin-screw extruder (L/D=30).

Various characteristics of the resulting multilayer insulated wire were tested and measured according to the following procedures.

A. Heat Resistance (1)

The heat resistance was evaluated by the following test method, in conformity to Annex U (Insulated wires) of Item 2.9.4.4 and Annex C (Transformers) of Item 1.5.3 of 60950-standards of the IEC standards.

Ten turns of the multilayer insulated wire were wound around a mandrel of diameter 6 mm, under a load of 118 MPa (12 kgf/mm$^2$). They were heated for 1 hour, Class B, at 225° C. (Class E, 215° C.; Class F, 240° C.), and then for additional 71 hours, Class B, at 200° C. (Class E, 190° C.; Class F, 215° C.), and then they were kept in an atmosphere of 25° C. and humidity 95% RH for 48 hours. Immediately thereafter, a voltage of 3,000 V was applied thereto, for 1 min. When there was no electrical short-circuit, it was considered that it passed Class B (Class E, Class F). (The judgment was made with n=5. It was considered that it did not pass the test if it was NG even when n=1.)

B. Dielectric Breakdown Voltage

The dielectric breakdown voltage was measured in accordance with the twisted pair method of JIS C 3003$^{-1984}$ 11.(2). The results are shown in kV unit. It was considered that it did not pass the test if the breakdown voltage was lower than 14 kV.

C. Heat Resistance (2)

The multilayer insulated wires were twisted in accordance with the twisted pair method of JIS C 3003$^{-1984}$, the resultant twisted wire was heated at a temperature of 220° C., Class B, for 168 hours (7 days), and then the dielectric breakdown voltage was measured. It is indicated that the larger that value is, the higher the heat resistance is. When the ratio of the dielectric breakdown voltage after the deterioration to the dielectric breakdown voltage before the heat treatment, namely, the residual ratio (%) of the dielectric breakdown voltage after the deterioration, is 50% or more, it is considered that the multilayer insulated wire roughly satisfies Heat Resistance Class B of the IEC standards Pub. 60172. In the tables, the results are shown by the residual ratio (%) of the aforementioned dielectric breakdown voltage after the sample was deteriorated.

D. Solvent Resistance

The sample was evaluated according to JIS C 3003$^{-1984}$ 14.1(2), wherein it was dipped in a solvent xylene for 30 minutes to confirm the pencil hardness of the coating film and whether it was swollen or not. The case where the pencil hardness was harder than H and no swelling was observed was rated as "pass". In the tables, the results not passing the test are shown by the resulting pencil strength (e.g. B) or as "sell" when the resulted sample was swelled.

E. Chemical Resistance

After a sample was produced according to a twisted pair method, it was impregnated with a xylene-type varnish TVB2024 (trade name, manufactured by TOSHIBA CHEMICAL CORPORATION) and a styrene monomer-type varnish TVB2180T (trade name, manufactured by TOSHIBA CHEMICAL CORPORATION), and then dried. Then, it was observed with the naked eye, to confirm whether or not cracks and the like were occurred on the sample. The case where no damage such as cracks was observed was rated as "pass".

F. Solderability

A length of about 40 mm at the end of the insulated wire was dipped in molten solder at a temperature of 450° C., and the time (sec) required for the adhesion of the solder to the dipped 30-mm-long portion was measured. The shorter the required time is, the more excellent the solderability is. The numerical value shown was the average value of n=3. The case where this time exceeds 10 seconds was rated as "fail", and the time is preferably within 5 seconds when the film thickness is about 100 μm, and within 7 seconds when the film thickness is about 180 μm.

G. Life Time

According to a twisted pair method, a sample was made by twisting the multilayer insulated wire with a bare wire (0.6 mm). Then, the time (hours) required until the sample was short-circuited was measured, while charging at normal temperature at a commercial frequency (50 Hz) and 2 kVrms. Whether an ozone odor was present or not was confirmed by a functional test, during the course of charging, to confirm whether partial discharge occurred or not for the evaluation of corona resistance.

TABLE 1

| | | | Example 1 | Example 2 | Example 3 | Example 4 | Example 5 |
|---|---|---|---|---|---|---|---|
| Conductor | | | Single wire | Twisted wire | Single wire | Single wire | Single wire |
| Production speed [m/min.] | | | 100 | 100 | 100 | 100 | 100 |
| Preheating temperature [° C.] | | | None | None | None | None | None |
| First layer | Resin(A) | PES | 100 | 100 | 100 | 100 | 100 |
| | | PEI | — | — | — | — | — |
| | Resin(B) | PC | — | — | — | — | — |
| | | PAR | — | — | — | — | — |
| | | PA | — | — | — | — | — |
| Coating thickness [μm] | | | 35 | 35 | 35 | 35 | 30 |
| Second layer | Resin(A) | PES | 100 | 100 | 100 | 100 | 100 |
| | | PEI | — | — | — | — | — |
| | Resin(B) | PC | — | — | — | — | — |
| Coating thickness [μm] | | | 35 | 35 | 35 | 35 | 30 |
| Third layer | Resin-1 | PPS-1 | 100 | 100 | — | — | 100 |
| | Resin-2 | PPS-2 | — | — | 100 | — | — |
| | Resin-3 | PPS-3 | — | — | — | 100 | — |
| | Resin(A) | PES | — | — | — | — | — |
| | Resin(B) | PC | — | — | — | — | — |
| | | PA | — | — | — | — | — |
| Coating thickness [μm] | | | 35 | 35 | 35 | 35 | 30 |
| Overall coating thickness | | | 105 | 105 | 105 | 105 | 90 |
| Wire appearance | | | Good | Good | Good | Good | Good |
| Heat resistance (1) | Class F | | Passed | Passed | Passed | Passed | Passed |
| | Class B | | Passed | Passed | Passed | Passed | Passed |
| | Class E | | ND | ND | ND | ND | ND |
| Dielectric breakdown voltage [kV] | | | 24.5 | 25.0 | 26.3 | 24.5 | 22.7 |
| Heat resistance (2) | Class B [%] | | 92 | 89 | 90 | 92 | 88 |
| Solvent resistance | | | Passed | Passed | Passed | Passed | Passed |
| Chemical resistance | | | Passed | Passed | Passed | Passed | Passed |
| Solderability [sec] | | | ND | ND | ND | ND | ND |

| | | | Example 6 | Example 7 | Comparative example 1 | Comparative example 2 |
|---|---|---|---|---|---|---|
| Conductor | | | Single wire | Single wire | Single wire | Single wire |
| Production speed [m/min.] | | | 100 | 100 | 100 | 100 |
| Preheating temperature [° C.] | | | None | 140 | None | None |
| First layer | Resin (A) | PES | 100 | 100 | 100 | 100 |
| | | PEI | — | — | — | — |
| | Resin (B) | PC | — | — | — | — |
| | | PAR | — | — | — | — |
| | | PA | — | — | — | — |
| Coating thickness [μm] | | | 60 | 35 | 35 | 35 |
| Second layer | Resin (A) | PES | 100 | 100 | 100 | 100 |
| | | PEI | — | — | — | — |
| | Resin (B) | PC | — | — | — | — |
| Coating thickness [μm] | | | 60 | 35 | 35 | 35 |
| Third layer | Resin-1 | PPS-1 | 100 | 100 | — | — |
| | Resin-2 | PPS-2 | — | — | — | — |
| | Resin-3 | PPS-3 | — | — | — | — |
| | Resin (A) | PES | — | — | 100 | — |
| | Resin (B) | PC | — | — | — | — |
| | | PA | — | — | — | 100 |
| Coating thickness [μm] | | | 60 | 35 | 35 | 35 |
| Overall coating thickness | | | 180 | 105 | 105 | 105 |
| Wire appearance | | | Good | Good | Good | Good |
| Heat resistance (1) | Class F | | Passed | Passed | Not Passed | Not Passed |
| | Class B | | Passed | Passed | Passed | Passed |
| | Class E | | ND | ND | ND | ND |
| Dielectric breakdown voltage [kV] | | | 27.5 | 25.5 | 22.0 | 20.5 |
| Heat resistance (2) | Class B [%] | | 95 | 90 | 90 | 45 |
| Solvent resistance | | | Passed | Passed | Swelled | Passed |
| Chemical resistance | | | Passed | Passed | Cracks occurred | Passed |
| Solderability [sec] | | | ND | ND | ND | ND |

TABLE 2

| | | | Example 8 | Example 9 | Example 10 | Example 11 | Example 12 |
|---|---|---|---|---|---|---|---|
| Conductor | | | Single wire | Twisted wire | Single wire | Single wire | Single wire |
| Production speed [m/min.] | | | 100 | 100 | 100 | 100 | 100 |
| Preheating temperature [° C.] | | | None | None | None | None | None |
| First layer | Resin (A) | PES | 100 | 100 | 100 | 100 | 100 |
| | | PEI | — | — | — | — | — |
| | Resin (B) | PC | 40 | 40 | 20 | 40 | 40 |
| | | PAR | — | — | — | — | — |
| | | PA | — | — | — | — | — |
| | Coating thickness [μm] | | 35 | 35 | 33 | 35 | 35 |
| Second layer | Resin (A) | PES | 100 | 100 | 100 | 100 | 100 |
| | | PEI | — | — | — | — | — |
| | Resin (B) | PC | 40 | 40 | 20 | 40 | 40 |
| | Coating thickness [μm] | | 33 | 35 | 33 | 33 | 33 |
| Third layer | Resin-1 | PPS-1 | 100 | 100 | 100 | — | — |
| | Resin-2 | PPS-2 | — | — | — | 100 | — |
| | Resin-3 | PPS-3 | — | — | — | — | 100 |
| | Resin (A) | PES | — | — | — | — | — |
| | Resin (B) | PC | — | — | — | — | — |
| | | PA | — | — | — | — | — |
| | Coating thickness [μm] | | 35 | 35 | 34 | 35 | 35 |
| Overall coating thickness | | | 103 | 105 | 100 | 103 | 103 |
| Wire appearance | | | Good | Good | Good | Good | Good |
| Heat resistance (1) | | Class F | ND | ND | ND | ND | ND |
| | | Class B | Passed | Passed | Passed | Passed | Passed |
| | | Class E | ND | ND | ND | ND | ND |
| Dielectric breakdown voltage [kV] | | | 25.5 | 28.2 | 27.4 | 25.6 | 25.3 |
| Heat resistance (2) [%] | | | 95 | 94 | 94 | 95 | 97 |
| Solvent resistance | | | Passed | Passed | Passed | Passed | Passed |
| Chemical resistance | | | Passed | Passed | Passed | Passed | Passed |
| Solderability [sec] | | | 3.0 | 3.5 | 3.5 | 3.0 | 5.0 |

| | | | Example 13 | Example 14 | Example 15 | Example 16 |
|---|---|---|---|---|---|---|
| Conductor | | | Single wire | Single wire | Single wire | Single wire |
| Production speed [m/min.] | | | 100 | 100 | 100 | 100 |
| Preheating temperature [° C.] | | | None | None | None | 140 |
| First layer | Resin (A) | PES | 100 | 100 | 50 | 100 |
| | | PEI | — | — | 50 | — |
| | Resin (B) | PC | 65 | — | — | 40 |
| | | PAR | — | 40 | — | — |
| | | PA | — | — | 20 | — |
| | Coating thickness [μm] | | 35 | 60 | 35 | 35 |
| Second layer | Resin (A) | PES | 100 | 100 | 100 | 100 |
| | | PEI | — | — | — | — |
| | Resin (B) | PC | 65 | 40 | 40 | 40 |
| | Coating thickness [μm] | | 33 | 60 | 33 | 33 |
| Third layer | Resin-1 | PPS-1 | 100 | 100 | 100 | 100 |
| | Resin-2 | PPS-2 | — | — | — | — |
| | Resin-3 | PPS-3 | — | — | — | — |
| | Resin (A) | PES | — | — | — | — |
| | Resin (B) | PC | — | — | — | — |
| | | PA | — | — | — | — |
| | Coating thickness [μm] | | 33 | 60 | 35 | 35 |
| Overall coating thickness | | | 101 | 180 | 103 | 103 |
| Wire appearance | | | Good | Good | Good | Good |
| Heat resistance (1) | | Class F | ND | ND | ND | ND |
| | | Class B | Passed | Passed | Passed | Passed |
| | | Class E | ND | ND | ND | ND |
| Dielectric breakdown voltage [kV] | | | 26.3 | 35.5 | 24.5 | 25.0 |
| Heat resistance (2) | | [%] | 85 | 98 | 90 | 95 |
| Solvent resistance | | | Passed | Passed | Passed | Passed |
| Chemical resistance | | | Passed | Passed | Passed | Passed |
| Solderability [sec] | | | 3.0 | 7.0 | 3.5 | 5.0 |

TABLE 3

| | | | Example 17 | Example 18 | Example 19 |
|---|---|---|---|---|---|
| Conductor | | | Single wire | Single wire | Single wire |
| Production speed [m/min.] | | | 100 | 100 | 100 |
| Preheating temperature [° C.] | | | None | None | None |
| First layer | Resin (A) | PES | — | — | — |
| | | PEI | 100 | 100 | 100 |
| | Resin (B) | PC | 40 | 20 | 40 |

TABLE 3-continued

| | | | | | |
|---|---|---|---|---|---|
| | | PAR | — | — | — |
| | | PA | — | — | — |
| | Coating thickness [μm] | | 33 | 33 | 33 |
| Second layer | Resin (A) | PES | — | 100 | 100 |
| | | PEI | 100 | — | — |
| | Resin (B) | PC | 40 | 40 | 40 |
| | Coating thickness [μm] | | 33 | 33 | 33 |
| Third layer | Resin-1 | PPS-1 | 100 | 100 | 100 |
| | Resin-2 | PPS-2 | — | — | — |
| | Resin-3 | PPS-3 | — | — | — |
| | Resin (A) | PES | — | — | — |
| | Resin (B) | PC | — | — | — |
| | | PA | — | — | — |
| | Coating thickness [μm] | | 35 | 35 | 35 |
| Overall coating thickness | | | 101 | 101 | 101 |
| Wire appearance | | | Good | Good | Good |
| Heat resistance (1) | Class F | | ND | ND | ND |
| | Class B | | Passed | Passed | Passed |
| | ClassE | | ND | ND | ND |
| Dielectric breakdown voltage [kV] | | | 26.1 | 25.5 | 25.3 |
| Heat resistance (2) | [%] | | 90 | 96 | 88 |
| Solvent resistance | | | Passed | Passed | Passed |
| Chemical resistance | | | Passed | Passed | Passed |
| Solderability [sec] | | | 3.0 | 3.5 | 3.5 |

| | | | Comparative example 3 | Comparative example 4 | Comparative example 5 |
|---|---|---|---|---|---|
| Conductor | | | Single wire | Single wire | Single wire |
| Production speed [m/min.] | | | 100 | 100 | 100 |
| Preheating temperature [° C.] | | | None | None | None |
| First layer | Resin (A) | PES | 100 | — | — |
| | | PEI | — | 100 | — |
| | Resin (B) | PC | — | — | 100 |
| | | PAR | — | — | — |
| | | PA | — | — | — |
| | Coating thickness [μm] | | 33 | 33 | 33 |
| Second layer | Resin (A) | PES | 100 | — | — |
| | | PEI | — | 100 | — |
| | Resin (B) | PC | — | — | 100 |
| | Coating thickness [μm] | | 33 | 33 | 33 |
| Third layer | Resin-1 | PPS-1 | — | — | — |
| | Resin-2 | PPS-2 | — | — | — |
| | Resin-3 | PPS-3 | — | — | — |
| | Resin (A) | PES | 100 | 100 | — |
| | Resin (B) | PC | — | — | 100 |
| | | PA | — | — | — |
| | Coating thickness [μm] | | 35 | 35 | 35 |
| Overall coating thickness | | | 101 | 101 | 101 |
| Wire appearance | | | Good | Good | Good |
| Heat resistance (1) | Class F | | ND | ND | ND |
| | Class B | | Passed | Passed | Not Passed |
| | Class E | | ND | ND | Not Passed |
| Dielectric breakdown voltage [kV] | | | 25.8 | 25.4 | 25.5 |
| Heat resistance (2) | [%] | | 94 | 85 | 0.5 |
| Solvent resistance | | | B | B | B |
| Chemical resistance | | | Cracks occurred | Cracks occurred | Cracks occurred |
| Solderability [sec] | | | 20 or more | 20 or more | 10.0 |

TABLE 4

| | | | Example 20 | Example 21 | Example 22 | Example 23 | Example 24 |
|---|---|---|---|---|---|---|---|
| Conductor | | | Single wire | Single wire | Single wire | Single wire | Single wire |
| Production speed [m/min.] | | | 100 | 100 | 100 | 100 | 100 |
| Preheating temperature [° C.] | | | None | None | None | None | None |
| First layer | Resin (A) | PES | 100 | 100 | 100 | 100 | 100 |
| | Resin (B) | PC | 40 | — | — | 45 | 45 |
| | Inorganic filler | Titanium oxide | — | — | — | — | 16 |
| | Coating thickness [μm] | | 35 | 35 | 35 | 35 | 35 |
| Second layer | Resin (A) | PES | 100 | 100 | 100 | 100 | 100 |
| | Resin (B) | PC | 40 | — | — | 45 | 45 |
| | Inorganic filler | Titanium oxide | — | 15 | 65 | 16 | 16 |
| | Coating thickness [μm] | | 33 | 35 | 35 | 35 | 35 |

TABLE 4-continued

| | | | | | | | |
|---|---|---|---|---|---|---|---|
| Third layer | Resin-1 | PPS-1 | 100 | 100 | 100 | 100 | 100 |
| | Resin-2 | PPS-2 | — | — | — | — | — |
| | Resin-3 | PPS-3 | — | — | — | — | — |
| | Resin (A) | PES | — | — | — | — | — |
| | Resin (B) | PC | — | — | — | — | — |
| | | PA | — | — | — | — | — |
| | Coating thickness [μm] | | 35 | 35 | 35 | 35 | 35 |
| Overall coating thickness | | | 103 | 105 | 105 | 105 | 105 |
| Wire appearance | | | Good | Good | Good | Good | Good |
| Heat resistance (1) | Class F | | ND | Passed | Passed | ND | ND |
| | Class B | | Passed | Passed | Passed | Passed | Passed |
| | Class E | | ND | ND | ND | ND | ND |
| Dielectric breakdown voltage [kV] | | | 25.5 | 23.5 | 18.7 | 22.8 | 20.8 |
| Heat resistance (2) | Class B [%] | | 94 | 90 | 88 | 92 | 92 |
| Solvent resistance | | | Passed | Passed | Passed | Passed | Passed |
| Chemical resistance | | | Passed | Passed | Passed | Passed | Passed |
| Solderability [sec] | | | 3.5 | ND | ND | 4.5 | 5.0 |
| Life time [hr] | | | 750 | ND | ND | >1,000 | ND |

| | | | Example 25 | Example 26 | Comparative example 6 | Comparative example 7 |
|---|---|---|---|---|---|---|
| Conductor | | | Single wire | Single wire | Single wire | Single wire |
| Production speed [m/min.] | | | 100 | 100 | 100 | 100 |
| Preheating temperature [° C.] | | | None | None | None | None |
| First layer | Resin (A) | PES | 100 | 100 | 100 | 100 |
| | Resin (B) | PC | 45 | 45 | — | 45 |
| | Inorganic filler | Titanium oxide | — | — | — | — |
| | Coating thickness [μm] | | 35 | 35 | 35 | 35 |
| Second layer | Resin (A) | PES | 100 | 100 | 100 | 100 |
| | Resin (B) | PC | 45 | 45 | — | 45 |
| | Inorganic filler | Titanium oxide | 60 | 60 (silica) | 175 | 175 |
| | Coating thickness [μm] | | 35 | 35 | 35 | 35 |
| Third layer | Resin-1 | PPS-1 | 100 | 100 | — | — |
| | Resin-2 | PPS-2 | — | — | — | — |
| | Resin-3 | PPS-3 | — | — | — | — |
| | Resin (A) | PES | — | — | 100 | 100 |
| | Resin (B) | PC | — | — | — | — |
| | | PA | — | — | — | — |
| | Coating thickness [μm] | | 35 | 35 | 35 | 35 |
| Overall coating thickness | | | 105 | 105 | 105 | 105 |
| Wire appearance | | | Good | Good | Good | Good |
| Heat resistance (1) | Class F | | ND | ND | Not Passed | Not Passed |
| | Class B | | Passed | Passed | Not Passed | Not Passed |
| | Class E | | ND | ND | Passed | Passed |
| Dielectric breakdown voltage [kV] | | | 19.0 | 20.0 | 12.5 | 13.4 |
| Heat resistance (2) | Class B [%] | | 90 | 88 | 35 | 40 |
| Solvent resistance | | | Passed | Passed | B | B |
| Chemical resistance | | | Passed | Passed | Cracks occurred | Cracks occurred |
| Solderability [sec] | | | 7.0 | 7.0 | ND | 5.0 |
| Life time [hr] | | | ND | ND | ND | ND |

(Notes) In the tables, "—" means that the component was not added, and "ND" means that the test was not carried out.

The abbreviation representing each resin was as follows:

PES: SUMIKAEXCEL PES 3600 (trade name, manufactured by Sumitomo Chemical Co., Ltd.), a polyethersulfone resin;

PEI: ULTEM 1000 (trade name, manufactured by GE Plastics Ltd.), a polyetherimide resin;

PC: Lexan SP-1010 (trade name, manufactured by GE Plastics Ltd.), a polycarbonate resin;

PAR: U-polymer (trade name, manufactured by Unitika Ltd.), a polyarylate resin;

PA: ARLEN AE-4200 (trade name, manufactured by Mitsui Chemical), a polyamide resin;

PPS-1: Dic. PPS FZ2200-A5 (trade name, manufactured by Dainippon Ink & Chemicals, Inc.), tan δ=3.5, a polyphenylenesulfide resin;

PPS-2: Fortron 0220 A9 (trade name, manufactured by Polyplastics), tan δ=3.5, a polyphenylenesulfide resin;

PPS-3: LT-4P (trade name, manufactured by DIC EP), tan δ=5.9, a polyphenylensuilfide resin.

Herein, tan δ represents the ratio of (loss modulus/storage modulus).

The following facts are apparent from the results shown in Table 1.

Examples 1 to 7 exhibited good heat resistance and also had very good characteristics as to the solvent resistance and chemical resistance, since among the three layers, the two under layers were composed of the polyethersulfone resin and the outermost layer was composed of the polyphenylenesulfide resin.

However, in Comparative Example 1, since all of the three layers were composed of only the polyethersulfone resin, a higher level of heat resistance was not attained, the coating film was softened in respect to the solvent resistance, and cracks occurred in respect to the chemical resistance. In Comparative Example 2, the outermost layer was composed of the polyamide resin, and resistance to solvents and chemicals were exhibited. However, the heat resistance did not reach an intended level, and this comparative example scarcely passed heat resistance Class B of the above heat resistance (2), since, for example, thermal deterioration progressed from the surface.

From the results shown in Tables 2 and 3, the following facts are apparent.

Examples 8 to 19 exhibited good solderability and heat resistance and also had very good characteristics as to the solvent resistance and chemical resistance, since among the three layers, the two layers were composed of the resin mixture of the resins (A) and (B) falling within the range as defined in the present invention and the outermost layer was composed of the polyphenylenesulfide resin.

On the contrary, Comparative Example 3 had the structure obtained using only the polyethersulfone resin, and Comparative Example 4 had the structure obtained using a combination of the polyetherimide resin and the polyethersulfone resin. Although both of these comparative examples exhibited high heat resistance, they had such drawbacks that a solder did not stuck thereto in respect to the solderability, that the coating film was too soft in respect to the solvent resistance, and that cracks occurred in respect to the chemical resistance.

Comparative Example 5 was constructed by composing only the polycarbonate resin. Comparative Example 5 therefore had almost no heat resistance, and it was poor in each of solderability, solvent resistance and chemical resistance. Therefore, Comparative Example 5 could not reach the practical level.

Further, the following facts are apparent from the results shown in Table 4.

Each of Examples 21 to 26 had a structure in which among the three layers, the two under layers were composed of a composition obtained by blending the inorganic filler to the polyethersulfone resin or to the resin mixture of the resins (A) and (B) falling within the range defined in the present invention, and the outermost layer was composed of the polyphenylenesulfide resin. When the amount of the inorganic filler was within the range preferable in the present invention, each example exhibited good heat resistance and further had very good characteristics as to the solvent resistance and chemical resistance. Examples 23 to 26 also had good solderability.

On the contrary, in the case of Comparative Examples 6 and 7, the flexibility was adversely affected, since the outermost layer was composed of the polyethersulfone resin and the amount of the inorganic filler was large. Therefore, the heat resistance did not reach an intended level, and such problems that the coating film was too soft in respect to the solvent resistance and cracks occurred in respect to the chemical resistance, were accompanied in these comparative examples.

Example 20 had a long life time, and Example 23 in which the inorganic filler was utilized was further improved in life time and almost no ozone odor was generated during the test.

INDUSTRIAL APPLICABILITY

The multilayer insulated wire of the present invention, which is excellent in heat resistance and in chemical resistance, is useful as a lead wire or a winding of a transformer, to be incorporated, for example, in electrical and electronic machinery and tools.

Further, the transformer of the present invention is preferable as a transformer high in reliability.

Having described our invention as related to the present embodiments, it is our intention that the invention not be limited by any of the details of the description, unless otherwise specified, but rather be construed broadly within its spirit and scope as set out in the accompanying claims.

The invention claimed is:

1. A multilayer insulated wire having two or more extrusion-insulating layers provided on a conductor to coat the conductor, wherein at least one layer of the insulating layers is composed of a polyethersulfone resin, and wherein at least one layer other than said at least one insulating layer is provided as an outer layer to said at least one insulating layer and is composed of a polyphenylenesulfide resin, wherein said polyphenylenesulfide resin to form the at least one insulating layer initially has a loss modulus that is two or more times a storage modulus, at 300° C. and 1 rad/s in a nitrogen atmosphere.

2. The multilayer insulated wire as claimed in claim 1, wherein the outermost layer among the insulating layers is composed of a polyphenylenesulfide resin.

3. The multilayer insulated wire as claimed in claim 1, wherein the at least one insulating layer is composed of a mixture made by blending: 10 to 85 parts by weight of an inorganic filler, and 100 parts by weight of the polyethersulfone resin.

4. A transformer, comprising the multilayer insulated wire according to any one of claims 1, 2 and 3.

5. A multilayer insulated wire having two or more solderable extrusion-insulating layers provided on a conductor to coat the conductor, wherein at least one layer of the insulating layers is composed of a resin mixture made by blending: 100 parts by weight of a resin (A) of at least one selected from the group consisting of a polyetherimide resin and a polyethersulfone resin, and 10 parts by weight or more of a resin (B) of at least one selected from the group consisting of a polycarbonate resin, a polyarylate resin, a polyester resin and a polyamide resin, and wherein at least one layer other than the at least one insulating layer composed of the resin mixture is provided as an outer layer to the at least one insulating layer and is composed of a polyphenylenesulfide resin, wherein said polyphenylenesulfide resin to form the at least one insulating layer initially has a loss modulus that is two or more times a storage modulus, at 300° C. and 1 rad/s in a nitrogen atmosphere.

6. The multilayer insulated wire as claimed in claim 5, wherein the resin (A) is a polyethersulfone resin.

7. The multilayer insulated wire as claimed in claim 5, wherein the resin (B) is a polycarbonate resin.

8. The multilayer insulated wire as claimed in claim 5, wherein the resin (A) is a polyethersulfone resin and the resin (B) is a polycarbonate resin.

9. The multilayer insulated wire as claimed in claim 5, wherein the resin mixture is made by blending: 100 parts by weight of the resin (A), and 10 to 70 parts by weight of the resin (B).

10. The multilayer insulated wire as claimed in any one of claims 5 to 9, wherein the outermost layer among the insulating layers is composed of a polyphenylenesulfide resin.

11. The multilayer insulated wire as claimed in any one of claims 5 to 9, wherein the at least one insulating layer is composed of a mixture made by blending: 10 to 85 parts by weight of an inorganic filler, and 100 parts by weight of the resin mixture of the resin (A) and the resin (B).

12. A transformer, comprising the multilayer insulated wire according to any one of claims 5 to 9.

* * * * *